US011336010B2

(12) United States Patent
Fang et al.

(10) Patent No.: US 11,336,010 B2
(45) Date of Patent: May 17, 2022

(54) LIQUID CRYSTAL ANTENNA, METHOD FOR MANUFACTURING THE SAME, AND ELECTRONIC DEVICE

(71) Applicant: BOE Technology Group Co., Ltd., Beijing (CN)

(72) Inventors: Jia Fang, Beijing (CN); Yanzhao Li, Beijing (CN); Xiyuan Wang, Beijing (CN); Zongmin Liu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/754,316

(22) PCT Filed: Apr. 29, 2019

(86) PCT No.: PCT/CN2019/084954

§ 371 (c)(1),
(2) Date: Apr. 7, 2020

(87) PCT Pub. No.: WO2019/210825

PCT Pub. Date: Nov. 7, 2019

(65) Prior Publication Data

US 2020/0243969 A1 Jul. 30, 2020

(30) Foreign Application Priority Data

May 3, 2018 (CN) ..... 201810416360.8

(51) Int. Cl.
*H01Q 3/36* (2006.01)
*H01Q 9/04* (2006.01)

(52) U.S. Cl.
CPC ..... *H01Q 3/36* (2013.01); *H01Q 9/0407* (2013.01)

(58) Field of Classification Search
CPC ..... H01Q 1/36; H01Q 1/364; H01Q 1/38; H01Q 21/0006; H01Q 3/36; H01Q 9/04; H01Q 9/0407; H01Q 9/045; H01Q 9/0457
See application file for complete search history.

(56) References Cited

U.S. PATENT DOCUMENTS 10,795,209 B2 * 10/2020 Wang ..... G02F 1/31
2009/0278744 A1 * 11/2009 Kirino ..... H01Q 9/045 343/700 MS (Continued)

FOREIGN PATENT DOCUMENTS

CN 101308266 A 11/2008
CN 105308789 A 2/2016

(Continued)

OTHER PUBLICATIONS

Chinese Office Action and English language translation, CN Application No. 201810416360.8, dated Jun. 5, 2019, 9 pp.

*Primary Examiner* — Jason Crawford
(74) *Attorney, Agent, or Firm* — Myers Bigel, P.A.

(57) ABSTRACT

The disclosure provides a liquid crystal antenna including: a first substrate; a second substrate facing the first substrate; a third substrate facing the second substrate such that the second substrate is between the first substrate and the third substrate; a liquid crystal layer between the first substrate and the second substrate; a transmission line on a surface of the first substrate adjacent to the liquid crystal layer; a ground electrode on a surface of the second substrate adjacent to the liquid crystal layer; a feeder line and a radiation patch both on a surface of the third substrate, wherein the transmission line and the ground electrode form a signal transmission circuit, and the transmission line and the liquid crystal layer form a phase shifter. In addition, the disclosure also relates to a method for manufacturing the liquid crystal antenna and an electronic device including the liquid crystal antenna.

12 Claims, 3 Drawing Sheets

(56) References Cited

U.S. PATENT DOCUMENTS

| | | | | |
|---|---|---|---|---|
| 2012/0075154 | A1* | 3/2012 | Biglarbegian | H01Q 13/106 343/770 |
| 2015/0380789 | A1* | 12/2015 | Jakoby | H01P 1/184 343/905 |
| 2017/0054217 | A1* | 2/2017 | Hashimoto | H01Q 13/10 |
| 2019/0123454 | A1* | 4/2019 | Haziza | H01Q 21/065 |
| 2019/0341693 | A1* | 11/2019 | Haziza | H01P 1/181 |
| 2020/0089042 | A1* | 3/2020 | Cao | G02F 1/13731 |
| 2020/0243969 | A1* | 7/2020 | Fang | H01P 1/184 |
| 2021/0083379 | A1* | 3/2021 | Cao | H01P 11/001 |
| 2021/0265713 | A1* | 8/2021 | Fang | G02F 1/1313 |
| 2021/0273331 | A1* | 9/2021 | Misaki | H01L 27/124 |

FOREIGN PATENT DOCUMENTS

| | | | |
|---|---|---|---|
| CN | 106299627 | A | 1/2017 |
| CN | 106684551 | A | 5/2017 |
| CN | 108493592 | A | 9/2018 |
| CN | 108761862 | A | 11/2018 |
| JP | 2005213423 | A | 8/2005 |
| JP | 2005244458 | A | 9/2005 |
| WO | 2012080532 | A1 | 6/2012 |

* cited by examiner

LIQUID CRYSTAL ANTENNA, METHOD FOR MANUFACTURING THE SAME, AND ELECTRONIC DEVICE

CROSS REFERENCE TO RELATED APPLICATIONS

This application is a 35 U.S.C. 371 national stage application of PCT International Application No. PCT/CN2019/084954, filed on Apr. 29, 2019, which claims the benefit of priority of Chinese Patent Application No. 201810416360.8 filed on May 3, 2018, the entire disclosures of which are incorporated herein by reference.

TECHNICAL FIELD

The present disclosure relates to the technical field of antennas, and in particular, to a liquid crystal antenna and a method for manufacturing the same, and also to an electronic device including the liquid crystal antenna.

BACKGROUND

The development of communication technology requires antennas with desired performances. Liquid crystal antennas have the advantages of small size, light weight, low power consumption, and good conformality. Moreover, by using the anisotropy of the liquid crystal, the function of beam scanning can also be realized. Therefore, the liquid crystal antenna is considered to have broad prospects, and it has also been increasingly widely used. It is known that a liquid crystal antenna can be generally manufactured by a semiconductor process. In order to manufacture a liquid crystal antenna with high alignment accuracy, it is expected that the liquid crystal antenna can be manufactured completely based on a semiconductor process, and no production process other than the semiconductor process is required.

SUMMARY

According to one aspect of the present disclosure, there is provided a liquid crystal antenna, comprising: a first substrate; a second substrate disposed as facing the first substrate; a third substrate disposed as facing the second substrate such that the second substrate is located between the first substrate and the third substrate; a liquid crystal layer disposed between the first substrate and the second substrate; a transmission line disposed on a surface of the first substrate adjacent to the liquid crystal layer; a ground electrode disposed on a surface of the second substrate adjacent to the liquid crystal layer; a feeder line and a radiation patch, the feeder line and the radiation patch being disposed on a surface of the third substrate, wherein the transmission line and the ground electrode form a signal transmission circuit, and the transmission line and the liquid crystal layer form a phase shifter.

In some embodiments of the present disclosure, the ground electrode includes an opening to form a radiation groove. In some embodiments of the present disclosure, orthographic projections of the transmission line, the feeder line, and the radiation patch on the ground electrode at least partially overlap the radiation groove. In some embodiments of the present disclosure, a shape of the radiation groove is one of an H shape, a dumbbell shape, and a rectangle, or any combination thereof.

In some embodiments of the present disclosure, the feeder line and the radiation patch are disposed on a surface of the third substrate facing the second substrate. In some embodiments of the present disclosure, the feeder line and the radiation patch are disposed on a surface of the third substrate facing away from the second substrate.

In some embodiments of the present disclosure, the first substrate, the second substrate, and the third substrate are respectively made of a material selected from the group consisting of a polytetrafluoroethylene glass fiber pressed plate, a phenolic paper laminated plate, a phenolic glass cloth laminated plate, a quartz plate and a glass plate. In some embodiments of the present disclosure, the first substrate, the second substrate, and the third substrate are made of a same material. In some embodiments of the present disclosure, thicknesses of the first substrate, the second substrate, and the third substrate are each in a range of 100 μm to 10 mm. In some embodiments of the present disclosure, the first substrate, the second substrate, and the third substrate have a same thickness. In some embodiments of the present disclosure, the ground electrode, the transmission line, and the radiation patch are respectively made of a material selected from the group consisting of copper, gold, and silver. In some embodiments of the present disclosure, the ground electrode, the transmission line, and the radiation patch are made of a same material.

According to another aspect of the present disclosure, there is provided a method for manufacturing the liquid crystal antenna described above, the method comprising the following steps:

a) forming the transmission line on a surface of the first substrate;

b) forming the ground electrode on a surface of the second substrate;

c) forming the feeder line and the radiation patch on a surface of the third substrate;

d) setting the surface of the second substrate on which the ground electrode is provided as facing away from the third substrate, and performing first aligning and assembling on the second substrate and the third substrate;

e) coating encapsulant on a periphery region of the surface of the first substrate on which the transmission line is provided or the surface of the second substrate on which the ground electrode is provided, and dripping liquid crystal in a region defined by the encapsulant; and f) selling the surface of the first substrate on which the transmission line is provided and the surface of the second substrate on which the ground electrode is provided as facing each other, and then performing second aligning and assembling on the second substrate and the first substrate.

In some embodiments of the present disclosure, step b) further comprises: providing an opening in the ground electrode to form a radiation groove. In some embodiments of the present disclosure, the first aligning and assembling in step d) and the second aligning and assembling in step f) are implemented using a vacuum alignment system. In some embodiments of the present disclosure, the liquid crystal is dripped by using a One Drop Filling process in step e). In some embodiments of the present disclosure, forming the ground electrode and the radiation patch comprises: forming a conductive layer on a surface of a corresponding substrate by magnetron sputtering, thermal evaporation or electroplating; and patterning the conductive layer. In some embodiments of the present disclosure, the patterning is etching. In some embodiments of the present disclosure, step d) further comprises: setting the surface of the third substrate on which the radiation patch and the feeder line are provided as facing away from the second substrate, or setting it as facing the second substrate.

According to vet another aspect of the present disclosure, there is provided an electronic device comprising the liquid crystal antenna described above.

BRIEF DESCRIPTION OF THE DRAWINGS

The above and/or other features, objectives, and advantages of the present disclosure will become more apparent by reading the detailed description of the non-limiting embodiments with reference to the following drawings.

It should he understood that the drawings are only for illustrative description of the embodiments of the present disclosure, and they are not necessarily drawn to scale. Moreover, throughout the drawings, like reference numerals indicate like parts, elements, devices and/or steps.

DETAILED DESCRIPTION OF EMBODIMENTS

The disclosure will be described in detail below with reference to the drawings and embodiments. The described embodiments are exemplary, only for explaining the present disclosure and should not be construed as limits of the present disclosure. If any specific technology or condition is not indicated in the described embodiments, the technology or condition described in the literature in the art or the product specification will be performed. If the manufacturers of any reagents or instruments as used are not specified, the reagents and instruments are all conventional products that can be commercially available.

Figure 1:
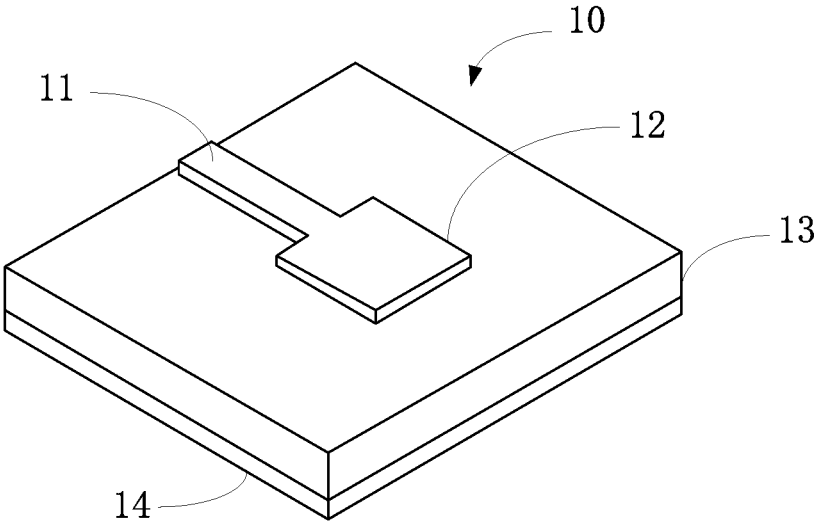
Fig. 1 Prior Art
FIG. 1 schematically illustrates a microstrip antenna in the related art.

FIG. 1 schematically illustrates a microstrip antenna 10 in the related art. The microstrip antenna 10 has a layer of thin dielectric substrate 13, and a patterned metal thin layer is deposited on both surfaces of the dielectric substrate 13. One metal thin layer serves as a ground electrode 14, and the other metal thin layer forms a patch to serve as a radiation antenna unit, that is, a feeder line 11 and a radiation patch 12. In a general microstrip antenna, a ground electrode, a feeder line, and a radiation patch are usually formed on opposite two-side surfaces of a substrate. Therefore, the manufacture of such a microstrip antenna involves a double-sided exposure, such that the manufacturing process is relatively complicated, and the cost is relatively high.

Figure 2:
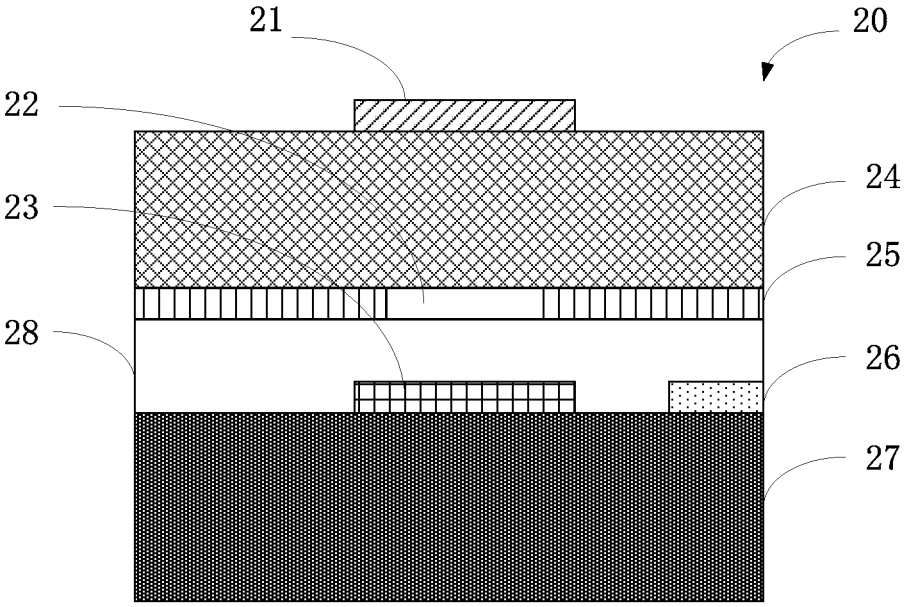
Fig. 2 Prior Art
FIG. 2 schematically illustrates a liquid crystal antenna in the related art in the form of a cross-sectional view.

FIG. 2 schematically illustrates a liquid crystal antenna 20 in the related art in the form of a cross-sectional view. It is known that a liquid crystal antenna generally includes two parts: a microstrip antenna unit and a phase shift unit, and the two units share one ground electrode. The phase shift unit includes a liquid crystal layer, and can utilize anisotropy of liquid crystal to realize beam scanning. In the liquid crystal antenna 20 shown in FIG. 2, a radiation patch 21, a first substrate 24, and a ground electrode 25 including a radiation groove 22 constitute a. microstrip antenna unit of the liquid crystal antenna 20, a transmission line 23, a second substrate 27, and a liquid crystal layer 28 constitutes a phase shift unit of the liquid crystal antenna 20, and the feeder line 26 is located in the phase shift unit.

However, the liquid crystal antenna known in the related art has the following problems:

firstly, if the traditional signal feeding manner is used, the feeder line is located in the phase shift unit part. Because the thickness of the liquid crystal layer is only on the order of micrometers, it cannot be directly connected to an external excitation. Generally, a method of adding a dielectric substrate is used by inserting a dielectric substrate with a thickness close to the thickness of the liquid crystal cell into the liquid crystal cell to connect an external excitation source. However, this will cause loss and impedance mismatch when metal is in physical contact;

secondly, if the feeder line and the radiation patch are placed on one side, an external excitation source can be directly connected without the need for an additional dielectric substrate. However, the problem caused by this is that the first substrate needs to be exposed on both sides, which has a high cost. When one side is exposed, the other side of the first substrate needs a protective layer. In addition, the accuracy of exposure on both sides cannot be guaranteed;

thirdly, by introducing an additional dielectric substrate in the form of a printed circuit board (i.e., a PCB board), the radiating unit and the feeder line are partly manufactured on the additional dielectric substrate. However, since the PCB board is additionally processed, it cannot realize very accurate alignment with the liquid crystal cell manufactured by a semiconductor process.

Therefore, it is desirable to provide an improved liquid crystal antenna.

Figure 3:
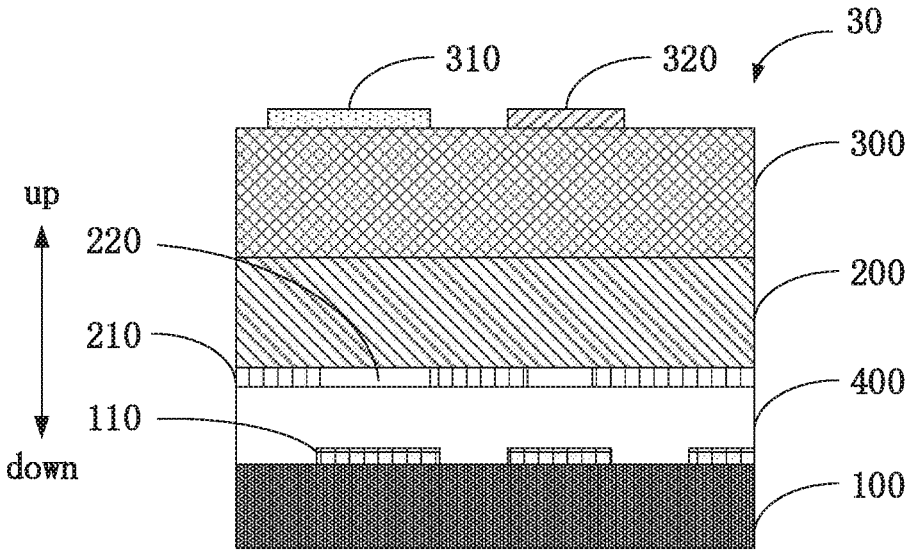
FIG. 3 schematically illustrates a liquid crystal antenna according to an embodiment of the present disclosure in the form of a cross-sectional view.

Referring to FIG. 3, a liquid crystal antenna 30 according to an embodiment of the present disclosure is schematically illustrated in the form of a cross-sectional view. Along the direction as shown by an arrow in FIG. 3 (that is, a bidirectional arrow showing an up-and-down direction), the liquid crystal antenna 30 includes, from bottom to top: a first substrate 100, a second substrate 200, and a third substrate 300 which are stacked in this order; a liquid crystal layer 400 disposed between the first substrate 100 and the second substrate 200; a transmission line 110 disposed on a surface of the first substrate 100 adjacent to the liquid crystal layer 400; a ground electrode 210 disposed on a surface of the second substrate 200 adjacent to the liquid crystal layer 400; a feeder line 310 and a radiation patch 320 that are both disposed on a surface of the third substrate 300 as facing away from the second substrate 200. The transmission line 110 and the ground electrode 210 form a signal transmission circuit, and the transmission line 110, the ground electrode 210. and the liquid crystal layer 400 form a phase shifter. In the embodiment shown in FIG. 3, the ground electrode 210 is further provided with an opening to form a radiation groove 220. The orthographic projections of the feeder line 310, the radiation patch 320, and the transmission line 110 on the ground electrode 210 at least partially overlap the radiation groove 220. In addition, according to some embodiments of the present disclosure, a shape of the radiation groove 220 may be one of an shape, a dumbbell shape, and a rectangle, or any combination thereof, and its size depends on the designed frequency and the used substrate so that the alignment is more accurate. It should be understood, however, that in some embodiments, the ground electrode 210 may not be provided with a radiation groove.

Figure 4:
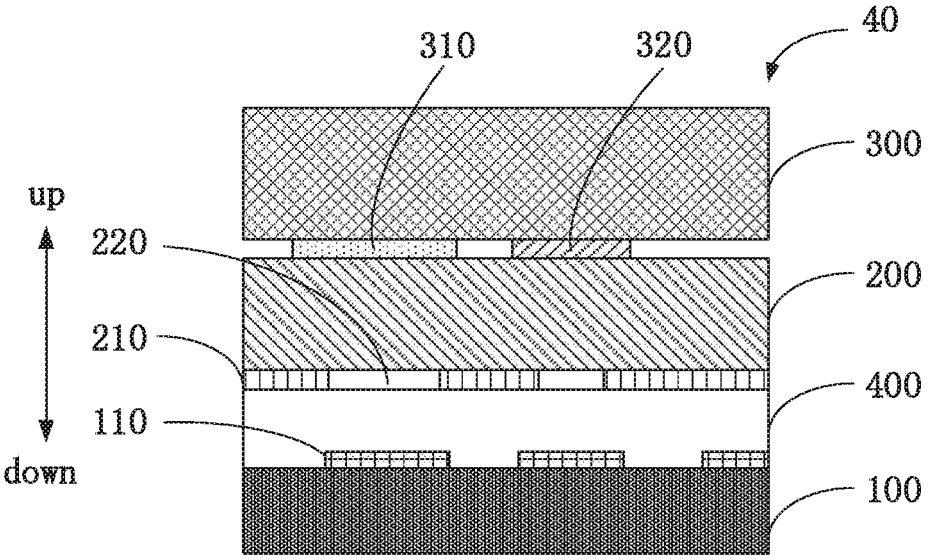
FIG. 4 schematically illustrates a liquid crystal antenna according to another embodiment of the present disclosure in the form of a cross-sectional view.

Referring now to FIG. 4, a liquid crystal antenna 40 according to another embodiment of the present disclosure is schematically illustrated in the form of a cross-sectional view. The liquid crystal antenna 40 is basically the same as the liquid crystal antenna 30 in structure, and the difference is only that the feeder line 310 and the radiation patch 320 are disposed on the surface of the third substrate 300 as facing the second substrate 200 in the liquid crystal antenna 40.

According to the embodiments of the present disclosure, in order to allow signals to enter or transmit from the liquid crystal antennas 30 and 40 smoothly, the first substrate 100, the second substrate 200, and the third substrate 300 may be made of rigid materials having low microwave loss. The first substrate 100, the second substrate 200, and the third substrate 300 may be made of a material, for example, but not limited to, selected from the group consisting of a polytetrafluoroethylene glass fiber pressed plate, a phenolic paper laminated plate, a phenolic glass cloth laminated plate, a quartz plate and a glass plate. Therefore, the materials used to manufacture the first substrate 100, the second substrate 200, and the third substrate 300 have a wide range of sources, good rigidity, good stability, good insulation effect, low microwave loss, and hardly affect the transmission of radio signals or electromagnetic waves. Therefore, the service performance of the liquid crystal antennas 30 and 40 is better. In some embodiments of the present disclosure, the first substrate 100, the second substrate 200, and the third substrate 300 may be made of the same material. In some embodiments of the present disclosure, one or two of the first substrate 100, the second substrate 200, and third substrate 300 may be made of different materials, or three of the first substrate 100, the second substrate 200, and the third substrate 300 may be made of materials different from each other.

According to the embodiment of the present disclosure, in order to meet the volume requirements of the liquid crystal antennas 30 and 40, the thicknesses of the first substrate 100, the second substrate 200, and the third substrate 300 are each in the range of 100 micrometers to 10 millimeters. For example, without limitation, the thicknesses of the first substrate 100, the second substrate 200, and the third substrate 300 may respectively be 100 μm, 300 μm, 500 μm, 700 μ, 900 μm, 1 mm, 2 mm, 4 mm, 6 mm, 8 mm, and 10 mm, etc. As a result, the finally obtained liquid crystal antennas 30 and 40 are small in size, light in weight, and convenient to carry. It should be understood that the thickness of the first substrate 100, the second substrate 200, or the third substrate 300 should be appropriately selected. When the thickness is too thin, the transmission line 110 may be too narrow, thereby causing a large loss in metal during microwave transmission, which deteriorates the overall performance of the liquid crystal antennas 30 and 40. However, when the thickness is too thick, the loss of radiation to space during signal transmission will increase, which also deteriorates the overall performance of the liquid crystal antennas 30 and 40.

According to the embodiments of the present disclosure, in order to improve the sensitivity of signal transmission, the material forming the radiation patch 320 is selected from at least one of copper, gold, and silver. Therefore, the radiation patch 320 has lower resistance, higher sensitivity for transmitting signals, less metal loss, and longer service life.

According to the embodiments of the present disclosure, the transmission line 110, the ground electrode 210, and the liquid crystal layer 400 together form a phase shifter, and its working principle is a delay line phase shift. Therefore, the loss in the microwave signal transmission process is particularly critical to the antenna performance, and a low-loss metal is required to form the transmission line 110 or the ground electrode. For example, the material forming the transmission line 110 or the ground electrode 210 may include at least one of copper, gold, and silver, in addition, the material forming the feeder line 310 may also be at least one of copper, gold, and silver, thereby reducing loss during signal transmission.

The liquid crystal antennas 30 and 40 according to the embodiments of the present disclosure have a simple structure and are easy to implement. By setting the ground electrode 210, the transmission line 110, the feeder line 310, and the radiation patch 320 on one-side surface of different substrates, respectively, a complicated and cumbersome double-sided exposure process is not required. By placing the radiation patch and the feeder line on the third substrate, the distance between the feeder line and the ground electrode is increased in a coupled manner, which is convenient for applying an excitation source without causing loss in the physical contact of metal. The liquid crystal antennas 30 and 40 according to the embodiments of the present disclosure can be completely manufactured by a semiconductor manufacturing process. The manufacturing steps and operations are relatively simple, the alignment is more accurate, the product yield is higher, the cost is lower, and it is suitable for large-scale production. In addition, since the alignment is more accurate, the liquid crystal antennas 30 and 40 according to the embodiments of the present disclosure have higher sensitivity for receiving or transmitting signals and better service performance.

Figure 5:
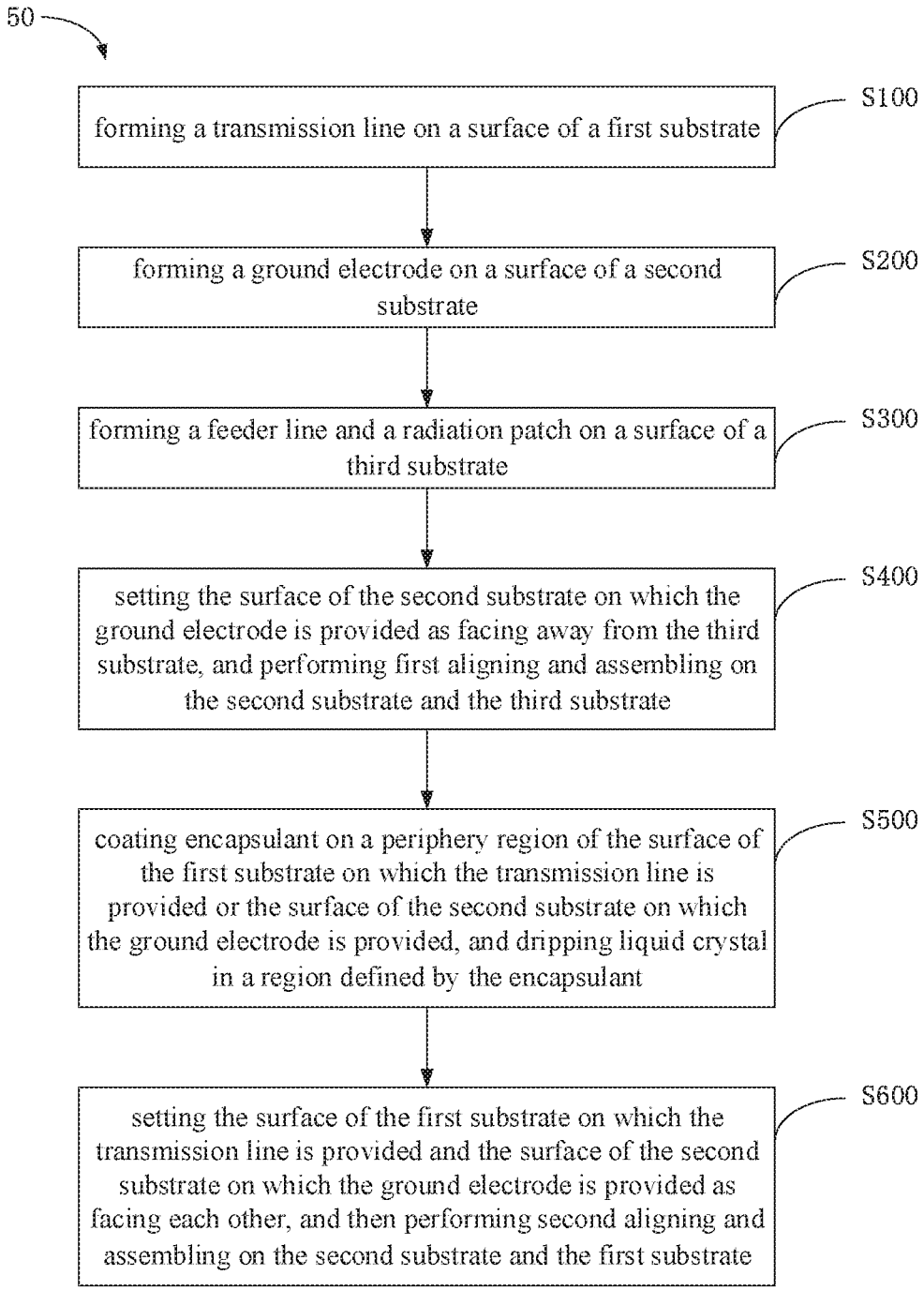
FIG. 5 is a schematic flowchart of a method for manufacturing a liquid crystal antenna according to an embodiment of the present disclosure.

Referring to FIG. 5, a method 50 for manufacturing a liquid crystal antenna according to an embodiment of the present disclosure is shown in the form of a schematic flowchart. The method 50 includes the following steps.

S100: forming a transmission line 110 on a surface of a first substrate 100.

According to the embodiment of the present disclosure, the first substrate 100 is consistent with the foregoing description, and is not repeated here. In addition, according to the embodiment of the present disclosure, the step of forming the transmission line 110 may include forming an entire surface of conductive layer by a method such as magnetron sputtering, thermal evaporation or electroplating, and then patterning the conductive layer to form the transmission line 110. The patterning is, for example, but not limited to, etching, and the like.

S200: forming a ground electrode 210 on a surface of a second substrate 200.

According to the embodiment of the present disclosure, the second substrate 200 and the ground electrode 210 are consistent with the foregoing description, and are not repeated here. According to the embodiment of the present disclosure, the step of forming the ground electrode 210 may include a method such as magnetron sputtering, thermal evaporation, or electroplating, so the operation is simple and convenient, easy to implement, low in cost, and suitable for large-scale production. According to some embodiments of the present disclosure, an opening may be further formed in the ground electrode 210 in step S200 to form the radiation groove 220. The manner of forming the radiation groove 220 is not particularly limited, as long as the requirements can be met, those skilled in the art can flexibly choose according to actual needs. The manner of forming the radiation groove 220 may be, for example, but not limited to, etching, cutting, and the like. For example, an entire surface of conductive layer may be formed on a surface of the second substrate 200 by a method such as magnetron sputtering, thermal evaporation or electroplating, and then the conductive layer may be patterned to form the radiation groove 220 in the ground electrode 210. The patterning is, for example, but not limited to, etching, and the like.

S300: forming a feeder line 310 and a radiation patch 320 on a surface of the third substrate 300.

According to the embodiment of the present disclosure, the third substrate 300, the radiation patch 320, and the feeder line 310 are consistent with the foregoing description, and are not repeated here. According to an embodiment of the present disclosure, a manner of forming the radiation patch 320 may be magnetron sputtering, thermal evaporation, electroplating, or the like. Therefore, the operation is simple and convenient, easy to implement, low in cost, and suitable for large-scale production. According to the embodiment of the present disclosure, the manner of forming the feeder line 310 is a conventional operation, and is not described in detail here.

S400: setting the surface of the second substrate 200 on which the ground electrode 210 is provided as facing away from the third substrate 300, and performing first aligning and assembling on the second substrate 200 and the third substrate 300.

It should be understood that, in step S400, the surface of the third substrate 300 on which the radiation patch 320 and the feeder line 310 are provided may also be set as facing away from the second substrate 200 or facing the second substrate 200. In addition, according to an embodiment of the present disclosure, the first aligning and assembling is implemented by, but not limited to, a vacuum alignment system (hereinafter referred to as VAS). For example, the specific operation of performing the aligning and assembling by a VAS is: coating UV glue on at least a part of the upper surface of the second substrate 200, placing the second substrate 200 coated with UV glue on the lower substrate of the VAS, where the surface coated with UV glue is placed as facing away from the lower substrate of the VAS, placing the third substrate 300 on the upper substrate of the VAS, performing the alignment by vacuuming and capturing the marks using a charge-coupled device (CCD) (graphics are obtained by changing the light and are compared with the graphics saved by the device to determine the positions of the marks. The positions of the marks depend on the requirement of the device, and are generally located on the edge region of the substrate), then performing accurate aligning and assembling on the second substrate 200 and the third substrate 300 by the press-down gravity, and finally realizing the accurate alignment between the second substrate 200 and the third substrate 300 by UV irradiation curing and hot baking.

S500: coating encapsulant on a periphery region of the surface of the first substrate 100 on which the transmission line 110 is provided or the surface of the second substrate 200 on which the ground electrode 210 is provided, and dripping liquid crystal in a region defined by the encapsulant.

According to the embodiment of the present disclosure, the above-mentioned encapsulant and liquid crystal are conventional materials, and details thereof are not described herein again. According to the embodiment of the present disclosure, the specific operation of this step may further include: for example, but not limited to, coating the encapsulant on a periphery region of a surface of the first substrate 100 on which the transmission line 110 is provided or a surface of the second substrate 200 on which the ground electrode 210 is provided, the encapsulant having a certain thickness in a direction perpendicular to the surface of the first substrate 100 (or the surface of the second substrate 200), and dripping liquid crystal in a region defined by the above-mentioned encapsulant by a One Drop Filling (hereinafter referred to as ODF) process, so that the liquid crystal can just fill the region.

S600: setting the surface of the first substrate 100 on which the transmission line 110 is provided and the surface of the second substrate 200 on which the ground electrode 210 is provided as facing each other, and then performing second aligning and assembling on the second substrate 200 and the first substrate 100.

According to an embodiment of the present disclosure, the second aligning and assembling is implemented by, for example, but is not limited to, the VAS. For example, the specific operation of performing the second aligning and assembling on the second substrate 200 and the first substrate 100 by using the VAS is as follows: sucking the first substrate 100 to the lower substrate of the VAS, sucking the second substrate 200 and the third substrate 300 that have been accurately aligned to the upper substrate of the VAS, setting the surface of the first substrate 100 on which the transmission line 110 is provided and the surface of the second substrate 200 on which the ground electrode 210 is provided as facing each other, then accurately aligning the two by the VAS, and then manufacturing a liquid crystal cell by an ultraviolet curing process and a hot baking manner. According to the embodiment of the present disclosure, it is necessary to use encapsulant when performing the second aligning and assembling to keep the filled liquid crystal in the space formed by the surface of the first substrate 100 on which the transmission line 110 is provided, the surface of the second substrate 200 on which the ground electrode 210 is provided, and the encapsulant.

In addition, it should be noted that the sequence of the first aligning and assembling in step S400 and the second aligning and assembling in step S600 is not particularly limited, as long as the requirements for the manufacturing of the liquid crystal antenna can be met, and those skilled in the art can flexibly make selections according to actual needs, It should also be understood that any other suitable known manner can also be used to achieve the aligning and assembling between the substrates, and the dripping of the liquid crystal.

In the method for manufacturing the liquid crystal antenna according to an embodiment of the present disclosure, the transmission line, the ground electrode, the radiation patch, and the feeder line can be respectively provided on one-side surfaces of three different substrates by using a one-side-exposure semiconductor process, so that the liquid crystal antenna can be completely manufactured by a semiconductor process, and the obtained liquid crystal antenna can be accurately aligned, and a liquid crystal cell that is completely consistent with the design can be manufactured. The yield of the liquid crystal antenna is higher, and the cost is lower, which can further expand the product coverage of semiconductor process lines.

In addition, based on the same inventive concept, an embodiment of the present disclosure also provides an electronic device including the aforementioned liquid crystal antenna according to the embodiments of the present disclosure. The electronic device has all the features and advantages of the aforementioned liquid crystal antenna according to the embodiments of the present disclosure, which will not be described in detail here. It should be understood that the specific type of the electronic device is not particularly limited, and may be any electronic device that needs to receive and/or transmit signals, including, for example, but not limited to, a mobile phone, a tablet computer, a television, a wearable device, a game console, and the like. It should also be understood that, in addition to the aforementioned liquid crystal antenna according to the embodiments of the present disclosure, the electronic device also includes structures and components necessary for conventional electronic devices. Taking a mobile phone as an example, it may also include a housing, a middle frame, a CPU, a display screen, a touch screen, a sound system, a fingerprint recognition module, and so on.

In the description of the present disclosure, it should be understood that, spatially relative terms of orientation or positional relationships indicated by, such as "center", "longitudinal", "transverse", "length", "width", "thickness", "upper", "lower", "front", "rear", "left", "right", "vertical", "horizontal", "top","bottom", "inside", "outside", "clockwise", "counterclockwise", "axial", "radial", "circumferential", "under", "underneath", "lower", "below", "above", "upper", etc. are based on the orientation or positional relationships shown in the drawings, and they are only for ease of description of one element or feature's relationship to another element(s) or feature(s) as illustrated in the figures, without indicating or implying that the indicated elements or features must have a specific orientation, be constructed and operated in a specific orientation, and therefore should not be construed as limiting the present disclosure. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both orientations of above and below. The device may be otherwise oriented (rotated 90 degrees or at other orientations) and the spatially relative descriptors used herein may be interpreted accordingly. In addition, it will also be understood that when a layer is referred to as being "between" two layers, it can be the only layer between the two layers, or one or more intervening layers may also be present.

It will be understood that, although the terms "first", "second", "third" etc. may be used herein to describe various elements, components, regions, layers and/or sections, these elements, components, regions, layers and/or sections should not be limited by these terms. These terms are only used to distinguish one element, component, region, layer or section from another. Thus, a first element, component, region, layer or section discussed below could be termed as a second element, component, region, layer or section without departing from the teachings of the present disclosure.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprise" and/or "include," when used in this specification, specify the presence of stated features, entities, steps, operations, elements, and/or components, but do not preclude the presence or addition of one or more other features, entities, steps, operations, elements, components, and/or groups thereof. As used herein, the term "and/or" includes any and all combinations of one or more of the associated listed items.

In this disclosure, unless otherwise explicitly specified and defined, the terms "install", "connect", "couple" and "fix" are to be understood broadly, and, for example, may be either a fixed connection or a detachable connection, or a connection in one piece; may be a mechanical connection or an electrical connection; may be a direct connection or an indirect connection through an intermediate medium, may be an internal communication between the two elements or interactions between the two elements. For those of ordinary skill in the art, the specific meanings of the above terms in the present disclosure can be understood on a case-by-case basis.

In addition, it should be understood that when an element or layer is referred to as being "on", "connected to", "coupled to", or "adjacent to" another element or layer, it can be directly on, connected, coupled, or adjacent to another element or layer, or intervening elements or layers may be present. In contrast, when an element is referred to as being "directly on," "directly connected to", "directly coupled to", or "immediately adjacent to" another element or layer, there are no intervening elements or layers present. In no event, however, should "on" or "directly on" be construed as requiring a layer to completely cover an underlying layer.

In the description of the present specification, the descriptions referring to the expressions of "one embodiment", "some embodiments", "example", "specific examples", or "some examples" or the like are intended to mean the specific features, structures, materials or characteristics described in connection with the embodiments or examples are comprised in at least one embodiment or example of the present disclosure. In the present specification, the schematic representation of the above expressions is not necessarily directed to the same embodiment or example. Rather, the specific features, structures, materials, or characteristics as described may be combined in a suitable manner in any one or more embodiments or examples. In addition, various embodiments or examples described in the specification, as well as features of various embodiments or examples, may be combined or integrated by those skilled in the art without conflicting. It should be understood that, unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification, and will not be interpreted in an idealized or overly formal sense unless expressly so defined herein.

The above description is only illustration of the embodiments of the present disclosure and the technical principles applied. It should be understood by those skilled in the art that the scope of the present disclosure is not limited to the technical solutions of the specific combinations of the above technical features, but also covers other technical solutions formed by any combination of the above technical features or their equivalent features without 1( )departing from the concept of the present application. In addition, a person of ordinary skill in the art can make various modifications and variations to the described embodiments of the present disclosure without departing from the spirit of the present disclosure, and these modifications and variations should also be considered to fall within the scope of the present disclosure.

What is claimed is:

1. A liquid crystal antenna, comprising:

a first substrate;

a second substrate facing the first substrate;

a third substrate facing the second substrate such that the second substrate is between the first substrate and the third substrate;

a liquid crystal layer between the first substrate and the second substrate;

a transmission line on a surface of the first substrate adjacent to the liquid crystal layer;

a ground electrode on a surface of the second substrate adjacent to the liquid crystal layer; and a feeder line and a radiation patch distinct from the feeder line on a surface of the third substrate, wherein the transmission line and the ground electrode define a signal transmission circuit, and the transmission line and the liquid crystal layer define a phase shifter, and wherein the ground electrode is arranged between the second substrate and the liquid crystal layer.

2. The liquid crystal antenna according to claim 1, wherein the ground electrode comprises an opening defining a radiation groove.

3. The liquid crystal antenna according to claim 2, wherein orthographic projections of the transmission line, the feeder line, and the radiation patch on the ground electrode at least partially overlap the radiation groove.

4. The liquid crystal antenna according to claim 1, wherein the surface of the third substrate having the feeder line and the radiation patch thereon is facing the second substrate.

5. The liquid crystal antenna according to claim 1, wherein the surface of the third substrate having the feeder line and the radiation patch thereon is facing away from the second substrate.

6. The liquid crystal antenna according to claim 1, wherein the first substrate, the second substrate, and the third substrate are respectively made of a material selected from the group consisting of a polytetrafluoroethylene glass fiber pressed plate, a phenolic paper laminated plate, a phenolic glass cloth laminated plate, a quartz plate and a glass plate.

7. The liquid crystal antenna according to claim 1, wherein the first substrate, the second substrate, and the third substrate are made of a same material.

8. The liquid crystal antenna according to claim 1, wherein thicknesses of the first substrate, the second substrate, and the third substrate are each in a range of about 100 μm to about 10 mm.

9. The liquid crystal antenna according to claim 1, wherein the first substrate, the second substrate, and the third substrate have a same thickness.

10. The liquid crystal antenna according to claim 1, wherein the ground electrode, the transmission line, and the radiation patch are respectively made of a material selected from the group consisting of copper, gold, and silver.

11. The liquid crystal antenna according to claim 1, wherein the ground electrode, the transmission line, and the radiation patch are made of a same material.

12. An electronic device comprising the liquid crystal antenna according to claim 1.

* * * * *